US006059263A

United States Patent [19]

Otema et al.

[11] Patent Number: 6,059,263

[45] Date of Patent: May 9, 2000

[54] AUTOMOTIVE ALIGNMENT LIFT

[75] Inventors: Martin Otema, 15 Pine Ridge Drive, Scarborough, Ontario, Canada, M1M 2X4; Ray A. Walters, Kitchener; Jeffrey A. Stewart, Newmarket, both of Canada

[73] Assignee: Martin Otema, Scarborough, Canada

[21] Appl. No.: 09/181,600

[22] Filed: Oct. 29, 1998

[30] Foreign Application Priority Data

Apr. 19, 1998 [CA] Canada ..... 2235187

[51] Int. Cl.[7] ..... B66F 7/12

[52] U.S. Cl. ..... 254/89 H; 254/10 R; 254/90; 254/122

[58] Field of Search ..... 254/89 H, 10 R, 254/8 C, 423, 87 R, 122, 90

[56] References Cited

U.S. PATENT DOCUMENTS

| | | | |
|---|---|---|---|
| D. 343,488 | 1/1994 | Fletcher | D34/28 |
| 4,848,732 | 7/1989 | Rossato | 254/89 H |
| 4,901,980 | 2/1990 | Hansen | 254/90 |
| 5,031,726 | 7/1991 | Wakamiya | 254/89 H |
| 5,050,844 | 9/1991 | Hawk | 254/89 H |
| 5,096,159 | 3/1992 | Fletcher | 254/90 |
| 5,199,686 | 4/1993 | Fletcher | 254/90 |
| 5,211,265 | 5/1993 | Gregg | 254/122 |
| 5,967,494 | 10/1999 | Fiorese | 254/122 |

*Primary Examiner*—James G. Smith
*Assistant Examiner*—Lee Wilson
*Attorney, Agent, or Firm*—Dimock Stratton Clarizio; Mark B. Eisen

[57] ABSTRACT

A parallelogram lift in which the deck rails are raised by lifting legs affixed to sliding members that slide within channels in the deck rails. Link arms pivotally connect to the deck rail to each leg, so that the deck rail lifts vertically. A single hydraulic actuator is used to actuate the legs supporting each deck rail, which ensures that the deck rail remains level during the lifting and lowering processes. In the preferred embodiment the hydraulic system is serially coupled between the hydraulic cylinders associated with each deck rail, which ensures that the displacement of hydraulic pistons raising both deck rails is synchronous so that the two deck rails are lifted at the same rate and remain horizontally aligned throughout lifting and lowering, and an incremental braking system is provided which automatically locks the deck rails into any desired elevated position, reducing the load on the hydraulic system and providing a failsafe against free-falling of the deck rails in the event of hydraulic failure.

34 Claims, 9 Drawing Sheets

AUTOMOTIVE ALIGNMENT LIFT

FIELD OF INVENTION

This invention relates to lift systems. In particular, this invention relates to an automotive lift having improved lifting and stability.

SUMMARY OF THE INVENTION

Automotive lift systems are used to enable the inspection and repair of an automotive vehicle from beneath the vehicle. For many decades automotive lift systems were in-ground post systems in which a hydraulically actuated central post supported a platform or deck, to raise the vehicle and maintain it in an elevated position for repair and servicing. Often service personnel worked in a bay recessed into the floor beneath the lift.

More recently, above-ground systems have been developed in which the entire lift system is disposed above floor level. Such systems provide environmental advantages, because the hydraulic fluids which actuate the lift are often toxic so their use and storage underground should be avoided. Above-ground systems also simplify the design of the floor in the area of the service bay.

One type of above-ground automotive lift is known as a parallelogram lift in which the supporting platform, typically a pair of deck rails aligned with the vehicle's wheels, is raised on sets of legs which pivot in relation to the deck rails. By increasing the angular relation between the deck rails and the legs of the lift, the deck rails can be maintained relatively level while being raised to the desired height. This eliminates the central post, allowing service personnel unobstructed access to the underside of the vehicle. An example of such an automotive lift is described in U.S. Pat. No. 5,096,159 issued Mar. 17, 1992 to Fletcher, which is incorporated herein by reference.

However, such parallelogram lifts give rise to a number of problems. Because of the pivot connection between the legs of the lift and the deck rails, as the lift is raised the deck rails move in an arc, i.e. horizontally as well as vertically. This requires a large clear space at one end of the lift, to accommodate the horizontally shifting position of the deck rails during lifting and lowering. This can also pose a hazard to personnel or equipment positioned in the area into which the lift moves.

Moreover, because the level of the deck rails is determined by the pitch of at least four independently actuated legs, it is extremely difficult to maintain both deck rails properly levelled, and at the same level relative to each other, throughout the lifting and lowering processes. For some servicing procedures, for example wheel alignments, it is essential that the deck rails be maintained in almost perfect horizontal alignment. This requires very close synchronization between the separate hydraulic cylinders that actuate the legs of the lift.

In the event that one of the hydraulic actuators fails, the leg associated with the failed actuator can collapse, with potentially disastrous results. Moreover, unlike a post lift system, in a parallelogram lift system the weight borne by the hydraulic system increases as the lift is lowered and the legs assume a greater angulation relative to the deck rails and floor. This can present problems in the stability of the elevated deck rails, particularly at lower positions.

The present invention addresses these and other disadvantages of automotive parallelogram lift systems. In the preferred embodiment of the lift of the present invention, the legs are not pivotally connected directly to the deck rails. Each leg has an associated link arm connected to the deck rail and to the leg, and the upper end of each leg is slidably received by the deck rails. By positioning the connection between each link arm to its associated leg at about the midpoint of the leg, the lift rises vertically. This significantly reduces the space requirements of the lift, and avoids the potential hazard to personnel or objects positioned at either end of the lift.

According to the preferred embodiment of the invention a single hydraulic actuator is used to actuate the legs supporting one deck rail, which ensures that the deck rail remains level at all times during lifting and lowering. Further, in the preferred embodiment the hydraulic system is serially coupled between the hydraulic cylinders associated with each deck rail, i.e. the discharge of fluid from one hydraulic cylinder drives the other hydraulic cylinder, which ensures a synchronous displacement of both hydraulic pistons is so that the two deck rails are raised at the same rate and remain horizontally aligned throughout lifting and lowering.

Also, in the preferred embodiment an incremental braking system is provided which automatically locks the deck rails into any desired elevated position. This reduces reliance upon the hydraulic system and provides a failsafe against free-falling of the lift in the event of hydraulic failure.

The present invention thus provides an automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, and an associated link arm, having an upper end pivotally secured to the deck rail at a fixed position spaced from the path of travel of the sliding assembly and a lower end pivotally secured to an intermediate portion of the leg, and an actuator for applying a force to each sliding assembly, whereby the actuator forces each sliding assembly to move toward its associated link arm to alter an angulation between the leg relative to the deck rail.

The present invention further provides an automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, and an associated link arm, having an upper end pivotally secured to the deck rail at a fixed position spaced from the path of travel of the sliding assembly and a lower end pivotally secured to an intermediate portion of the leg, and a hydraulic cylinder secured at a fixed position on the deck rail to apply a force longitudinally along the deck rail, having a piston with a piston shaft extending from forward and rear ends of the cylinder, a forward end of the piston shaft being coupled to a forward sliding assembly and a rear end of the piston shaft being coupled to a rear sliding assembly, to move the forward and rear sliding assemblies in synchronous relation, the actuator forces each sliding assembly to move toward its associated link arm to alter an angulation between the leg relative to the deck rail and thus raise the deck rail.

The present invention further provides an automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, the path of travel having at least one row of slots extending along a portion of the length of the deck rail, and an associated link arm, having an upper end pivotally secured to the deck rail at a fixed position spaced from the path of travel of the sliding assembly and a lower end pivotally secured to an intermediate portion of the leg, and an actuator for applying a force to each sliding assembly, whereby the actuator forces each sliding assembly to move toward its associated link arm to alter an angulation between the leg relative to the deck rail, wherein each sliding assembly is provided with a pair of brake arms retractable from an extended position in which the brake arms extend into the slots to a retracted position in which the brake arms are retracted from the slots, the brake arms being biased toward the slots and being retractable a force applied to the brake arms.

BRIEF DESCRIPTION OF THE DRAWINGS

In drawings which illustrate by way of example only a preferred embodiment of the invention.

DETAILED DESCRIPTION OF THE INVENTION

Figure 1:
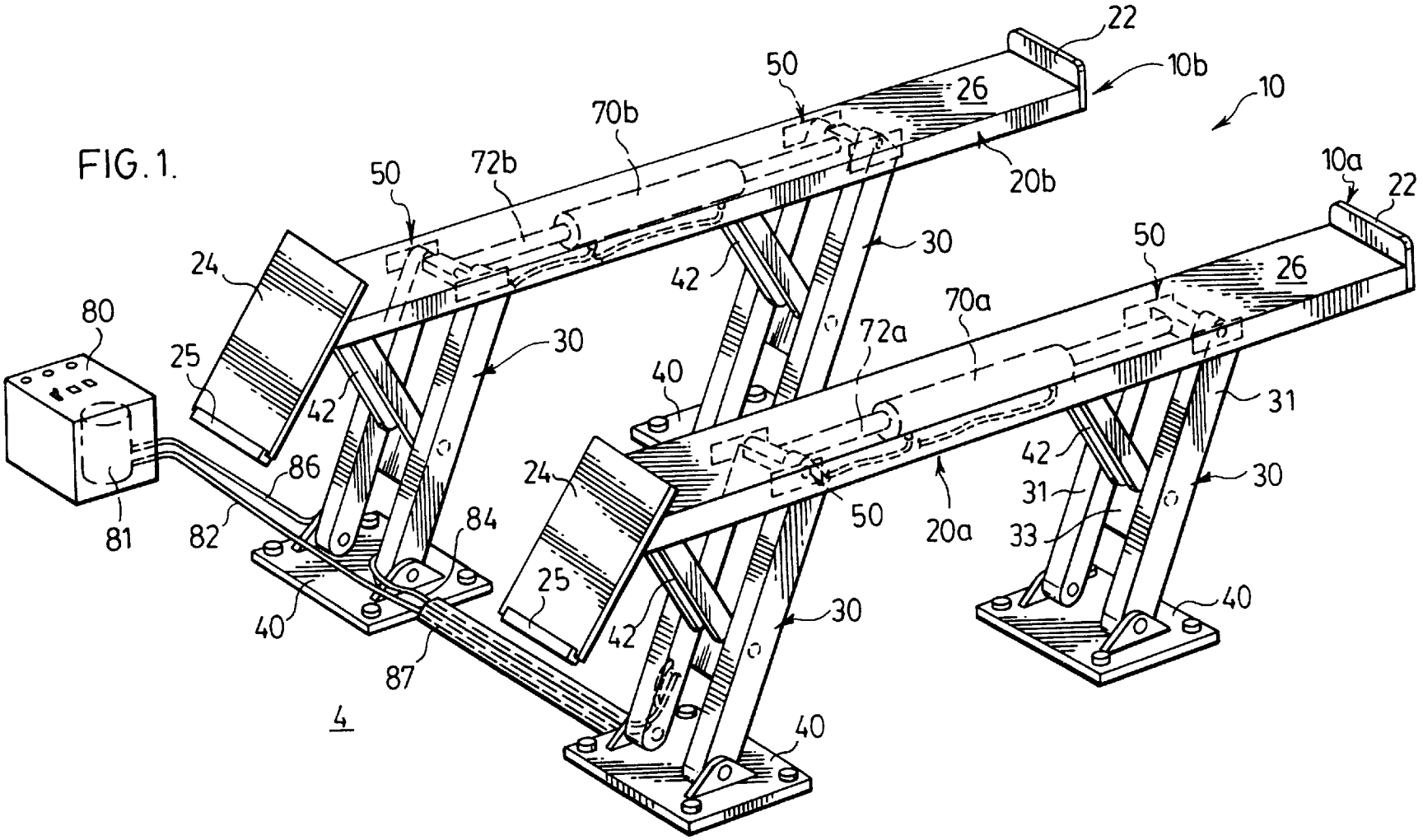
FIG. 1 is a perspective view of a preferred embodiment of an automotive lift embodying the invention.
Figure 2:
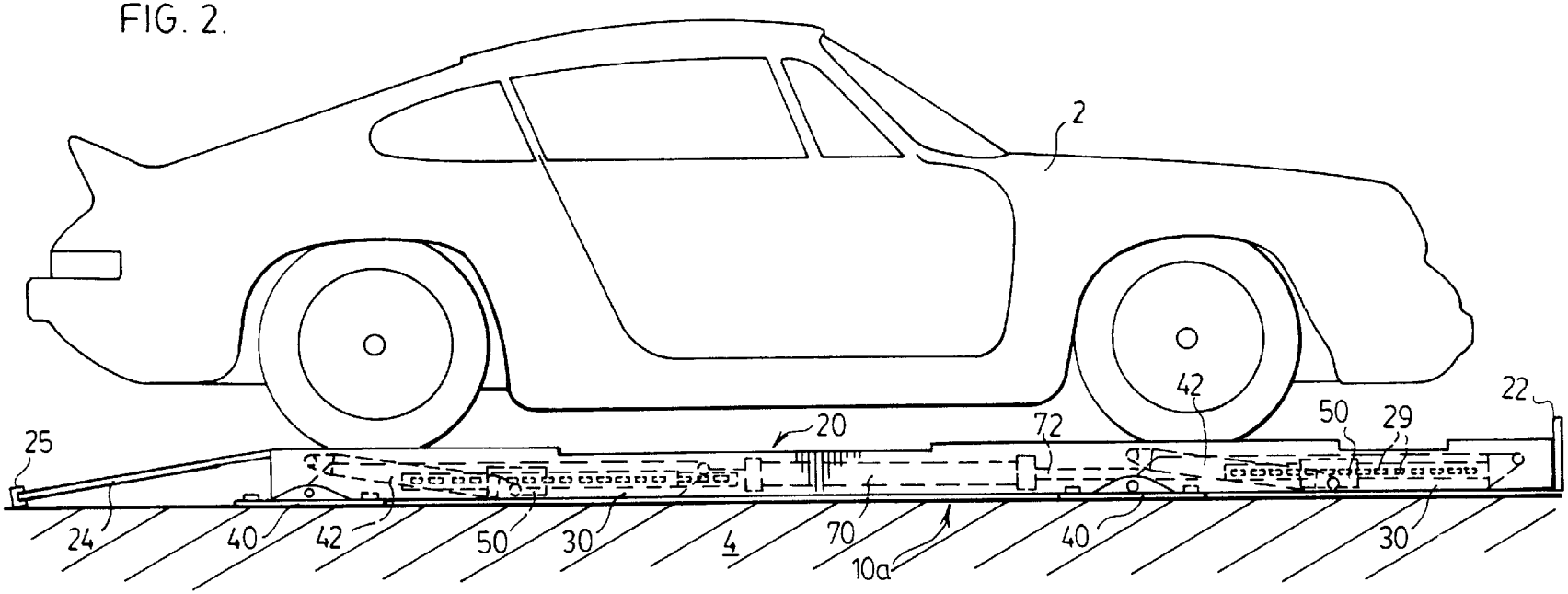
FIG. 2 is a side elevation of the automotive lift of FIG. 1 showing the lift in a lowered position.
Figure 3:
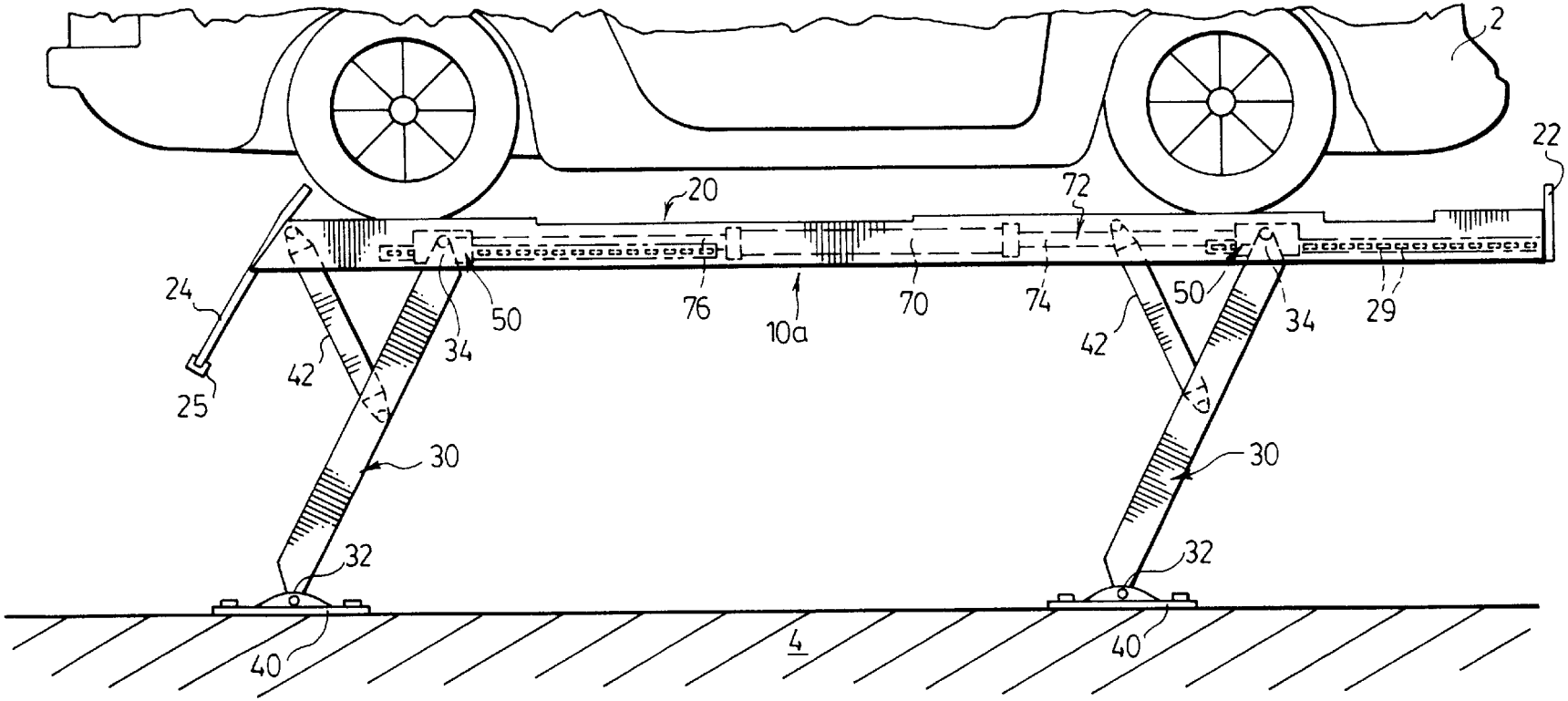
FIG. 3 is a side elevation of the automotive lift of FIG. 1 showing the lift in a raised position.

FIGS. 1 to 3 illustrate a preferred embodiment of the automotive lift 10 of the invention. The lift 10 conventionally comprises a pair of lift sections 10*a*, 10*b* respectively provided with deck rails 20*a* and 20*b*, which when installed are substantially parallel and are spaced apart a distance approximating the distance between the wheels of an automotive vehicle 2.

The width of each deck rail 20 is sufficient to accommodate the thickness of the vehicle's tires and varying wheelbase lengths of different vehicles 2, with sufficient clearance between the deck rails 20 to permit servicing and repairs to the underside of the vehicle 2. The deck rails 20 are preferably respectively provided with a fixed front barrier plate 22 to ensure that a vehicle is properly restrained on the deck rails 20, and a pivoting rear plate 24 which when the lift 10 is in the lowered position shown in FIG. 2 forms a ramp between the floor 26 of the deck rail 20 and the floor 4 of the service bay, which allows the vehicle 2 to be driven on and off of the lift 10.

The structure of the automotive lift of the invention will hereinafter be described in relation to one deck rail 20 (identified as 20*a* in FIG. 1) and the lifting and braking mechanisms associated therewith, it being appreciated that the structure of the other deck rail 20 (20*b* in FIG. 1) is substantially identical in the preferred embodiment. All of the lift components described below are preferably formed from hardened steel or another suitably rigid and structurally sturdy material.

Figure 5:
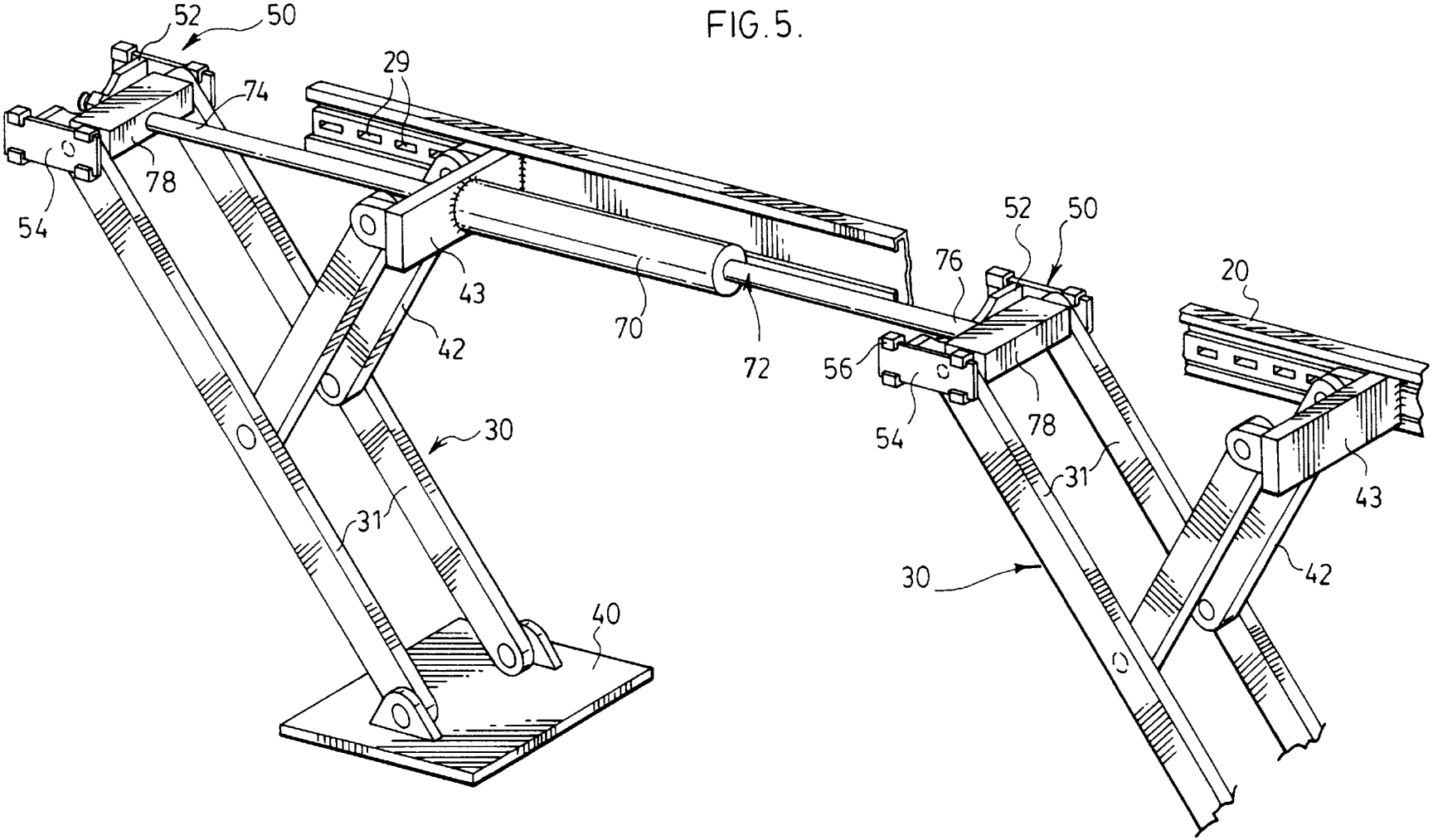
FIG. 5 is a cutaway perspective view of one deck rail.

The deck rail 20 is supported by lifting legs 30. According to a preferred embodiment of the invention, two lifting legs 30 are pivotally secured at their lower ends 32 to floor anchor plates 40 which are bolted to the floor 4 of the service bay in conventional fashion, and are pivotally secured at their upper ends 34 to sliding assemblies 50 engaged into channels 28 formed within the substructure of the deck rail 20, as shown in FIG. 5. Each lifting leg 30 comprises a pair of rigid supporting members 31 welded together by cross-plates 33, for greater strength.

Figure 6:
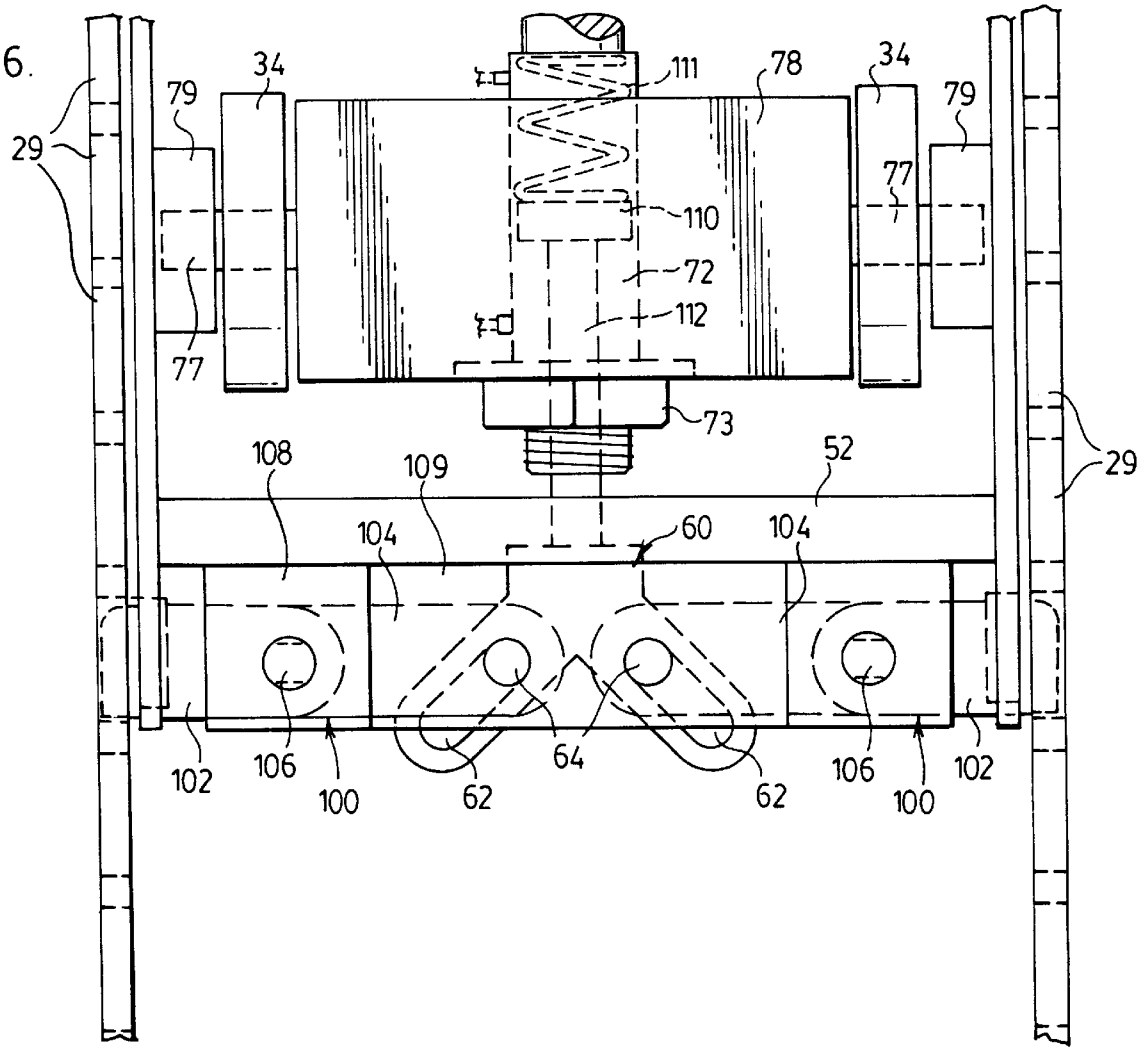
FIG. 6 is a top plan view of a preferred embodiment of the braking mechanism showing the brake engaged to the deck rail.

In the preferred embodiment the sliding assemblies 50, illustrated in FIGS. 6 to, comprise a sliding body 52 welded or otherwise affixed to wings 54 disposed vertically within the channels 28. The wings 54 are provided with low-friction slide blocks 56 which allow the wings 54 to slide relatively freely within the channels 28, so that each sliding assembly 50 can move along a path of travel defined by a portion of the length of the deck rail 20.

Each leg 30 is tied to the deck rail 20 by a link arm 42 having an upper end pivotally secured to the deck rail 20 at a fixed position spaced from the path of travel of the sliding assembly 50, as at link arm mount 43 welded to the deck rail 20 as shown in FIG. 5, and a lower end pivotally secured to an intermediate position on the leg 30. The angular relation of the link arm 42 relative to the upper portion of the leg 30 decreases in a toggle fashion as the sliding assembly 50 slides rearwardly along the deck rail 20. Thus, as the sliding assembly 50 attached to the top end 34 of each leg 30 slides rearwardly along the underside of the deck rail 20, the angular relation of the leg 30 relative to the deck rail 20 (and thus relative to the floor 4) increases, which raises the deck rail from the lowered position shown in FIG. 2 to a raised position such as that shown in FIG. 3.

Figure 4:
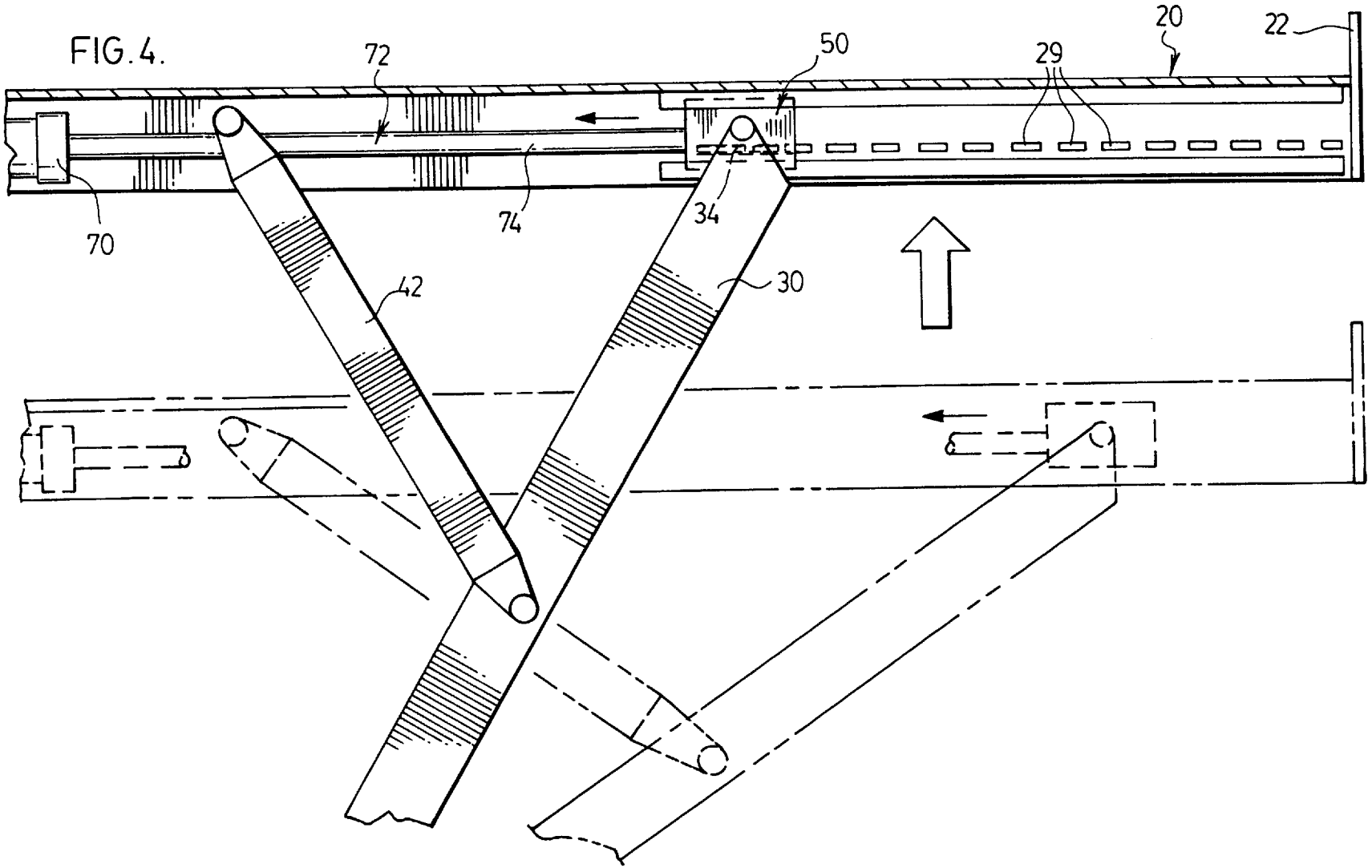
FIG. 4 is a cutaway elevation of showing the movement of the deck rail during lifting.

This configuration causes the deck rails 20 to rise vertically as the lift 10 is raised, as shown in FIG. 4. Optimal leverage is obtained when the link arm 42 is secured to its associated leg 30 at approximately the midpoint of the leg 30 as shown in the preferred embodiment illustrated. The length of the link arm 42 is preferably approximately one half of the length of the leg 30 in the preferred embodiment, so that in the lowered position shown in FIG. 2 the link arm 42 does not extend substantially beyond the bottom end 32 of the leg 30.

Thus, according to the invention the deck rail 20 is raised by applying a force to the sliding assemblies 50 to force them rearwardly along the channels 28, decreasing the angulation between the link arms 42 and the upper portions of the legs 30 and at the same time increasing the angular relation of the legs 30 relative to the deck rail 20 (and floor 4). In the preferred embodiment this is accomplished by providing a hydraulic actuator comprising a hydraulic cylinder 70 mounted at a fixed position, preferably concealed underneath the deck rail 20, between the respective paths of travel of the sliding assemblies 50. The hydraulic cylinder 70 is welded to any fixed component of the deck rail 20, for example the link arm mount 43 as illustrated in FIG. 5.

The hydraulic cylinder 70 drives a piston shaft 72 which projects out of both ends of the cylinder 70. The front end 74 of the piston shaft 72 is affixed to the front sliding assembly 50, and the rear end 76 of the piston shaft 72 is affixed to the rear sliding assembly 50. The sliding assemblies 50 thus slide synchronously along the channels 28, the distance between the front and rear sliding assemblies 50 being fixed by the length of the piston shaft 72.

The deck rail 20 is thus raised and lowered by changing the axial position of the piston shaft 72 relative to the hydraulic cylinder 70. To raise the deck rail 20 the piston shaft 72 is driven rearwardly, forcing the rear sliding assembly 50 (shown at the left in FIGS. 2 and 3) rearwardly; at the same time the front sliding assembly 50 (shown at the right in FIGS. 2 and 3) is drawn rearwardly in tandem with the rear sliding assembly 50. This synchronizes the change in the angulation of both legs 30 relative to the deck rail 20 and ensures that the deck rail 20 remains level at all times during lifting and lowering.

The hydraulic system further comprises a conventional hydraulic pump 81 controlled from (and preferably contained within) a remote operator's station 80, shown schematically in FIG. 1. The pump 81 is coupled to the inlet of one hydraulic cylinder (70*a* in FIG. 1) through hose 82. The outlet of the cylinder 70*a* is coupled to the inlet of the other hydraulic cylinder (70*a* in FIG. 1) through hose 84. The outlet of cylinder 70*b* discharges the hydraulic fluid back to the pump 81 through hose 86. The hydraulic cylinders 70*a*, 70*b* are thus effectively connected to the hydraulic pump 81 in series. This ensures that the two lift sections 10*a*, 10*b* are retained at the same level relative to each other at all times, because when the hydraulic cylinders 70 are operating (assuming that there are no leaks and all air has been bled from in the system) the exact same volume of hydraulic fluid is pumped through each hydraulic cylinder 70*a*, 70*b* to displace the piston shafts 72*a*, 72*b* by the same amount.

The hoses 82, 84, 86 should be securely fastened underneath the deck rails 20 and along the legs 30 and floor 4 (as by guard plate 87) so as not to obstruct the workspace beneath the lift 10.

In the preferred embodiment the piston 72 is secured through a piston block 78 and retained by a nut 73. The piston block 78 is affixed to the sliding assembly 50 by pins 77 which extend through the upper end 34 of the lifting leg 30 and are pivotally received in mounting blocks 79 welded to the wings 54 of the sliding assembly 50. Thus, the pins 77 serve the dual purpose of securing the piston 72 to the sliding assembly 50 and providing a structure about which the leg 30 can pivot as its angular relation to the deck rail 20 changes during lifting and lowering.

In the preferred embodiment the invention provides an incremental braking mechanism which locks the sliding assemblies 50 into position within the channels 28 at the desired elevation of the deck rail 20. The braking mechanism allows the deck rail 20 to be set to virtually any desired elevated position, and provides a means for preventing free-falling of the deck rail 20 in the event of hydraulic system failure.

Figure 7:
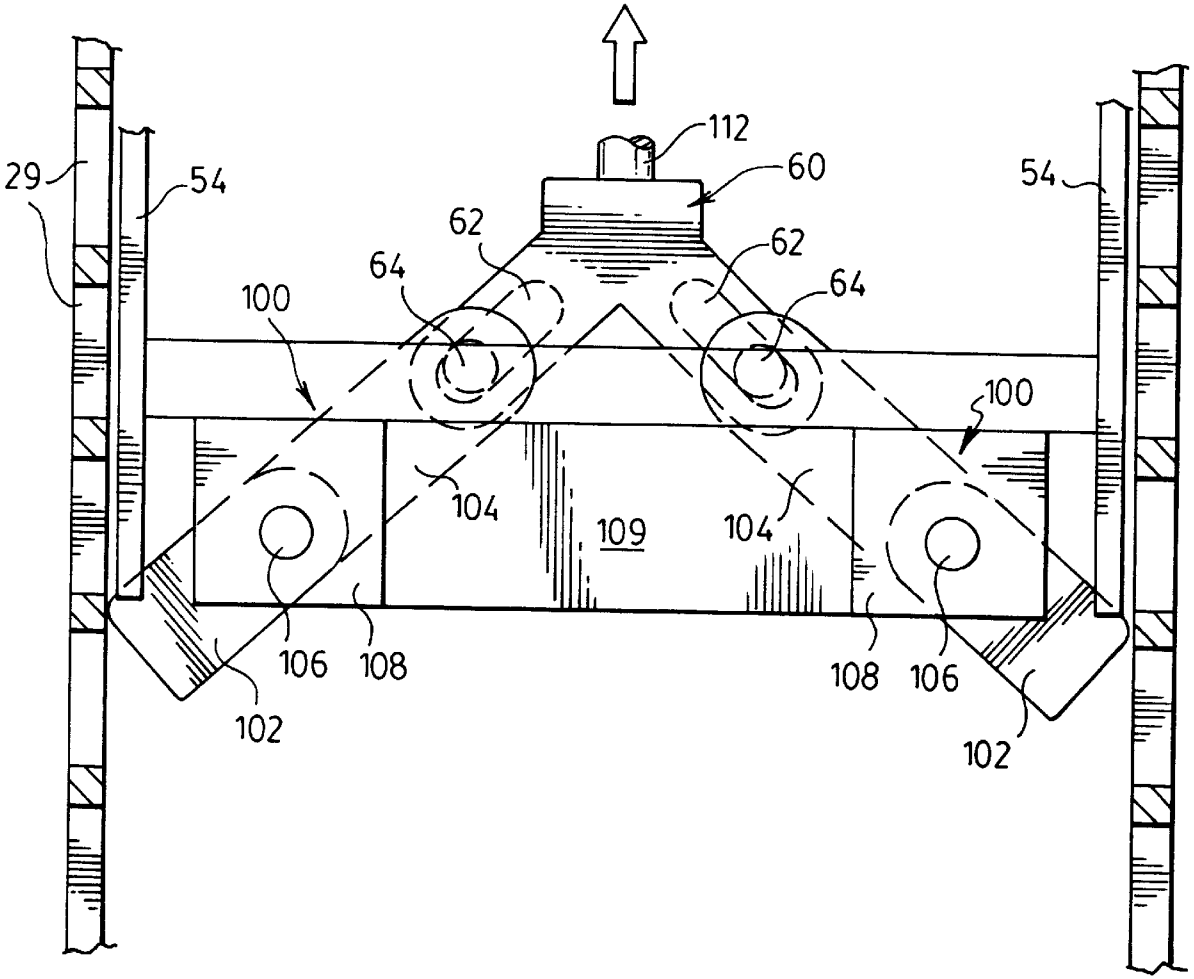
FIG. 7 is a top plan view of the braking mechanism of FIG. 6 showing the brake in a release position.
Figure 8:
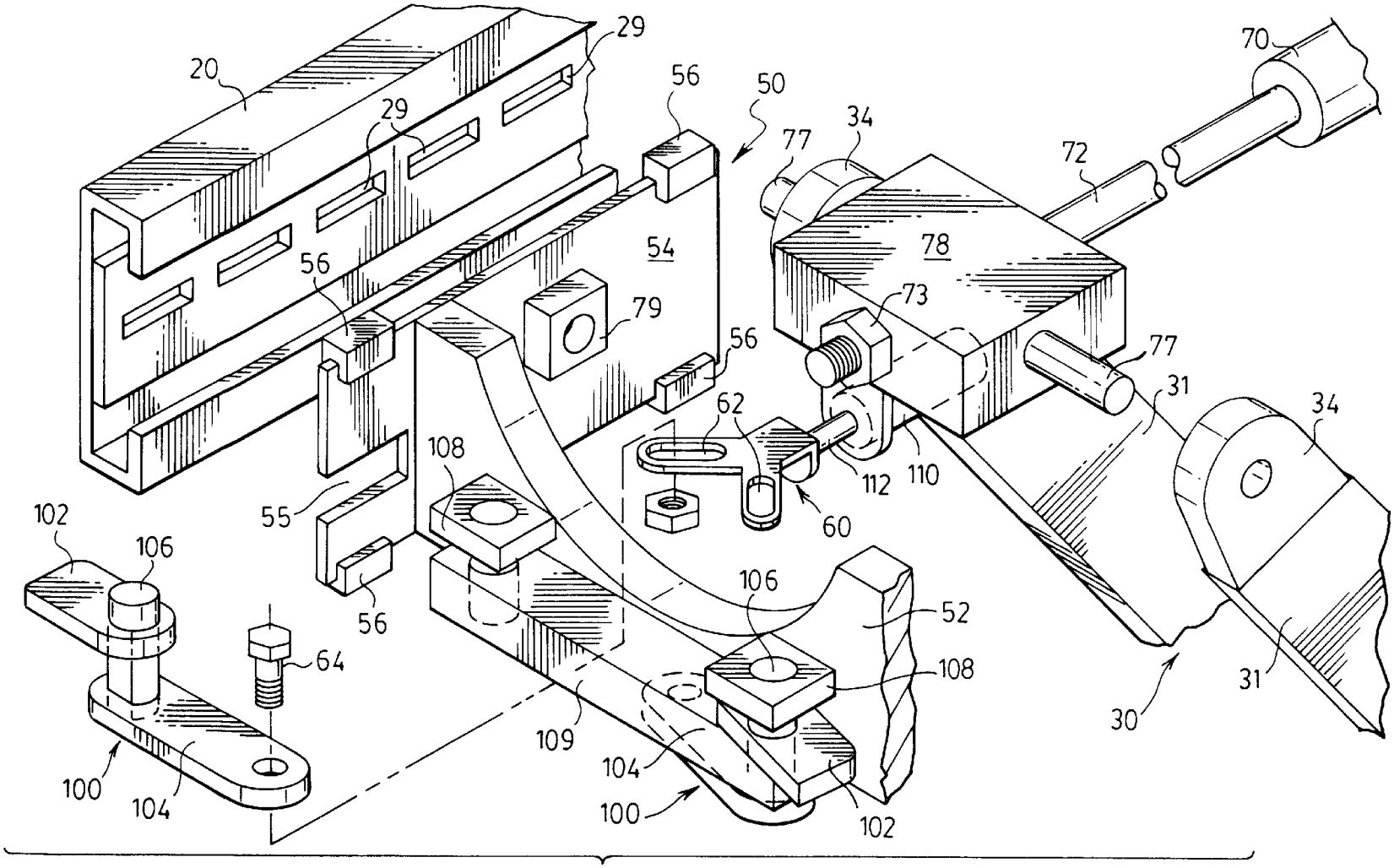
FIG. 8 is an exploded view of the braking mechanism of FIG. 6.

A preferred embodiment the braking mechanism is illustrated in FIGS. 6 to 8. The braking mechanism comprises a brake arms 100 pivotally secured to the sliding body 52. Each brake arm 100 preferably comprises a latching portion 102 secured to an actuating portion 104 by an obround pin or bolt 106 that rotationally locks the latching portion 102 to the actuating portion 104 and engages into mount 108 to serve as a pivot point for the brake arm 100.

The brake arms 100 are biased to the extended or braking position shown in FIG. 6, and can be pivoted about the pins 106 to the retracted position shown in FIG. 7 by drawing shackle 60 rearwardly. The shackle 60 is provided with slots 62 for receiving bolts or other suitable fasteners 64 affixed to the actuating portions 104 of the brake arms 100, the slots 62 being obliquely oriented to accommodate the change in lateral spacing between the actuating portions 104 as the brake arms 100 pivot between the retracted and extended positions.

The brake arms 100 cooperate with opposed rows of slots 29 disposed along the side wall of each channel 28, each slot 29 being large enough to receive the latching portion 102 of a brake arm 100. The slots 29 can be cut through the floor of the channel 28, but are preferably formed through a steel bar 27 which is then welded to the floor of the channel 28, and preferably the row of slots 29 extends along substantially the entire path of travel of the sliding assembly 50 (as best seen in FIG. 4). The slots 29 can be spaced apart at any selected interval, it being desirable to space the slots 29 as closely as possible so long as sufficient material remains between the slots 29 to safely retain the sliding assembly 50 in position under the weight of the vehicle 2. Thus, depending upon the type and thickness of material in which the slots 29 are formed, the sliding assemblies 50 can be locked into successive positions along the channel 28 in increments which may be as small as a few inches.

The wings 54 of the sliding assembly 50 are provided with notches 55 into which the latching portions 102 of the brake arms 100 recede and against which the brake arms 100 bear when in the extended position, to prevent the brake arms 100 from collapsing rearwardly (i.e. beyond the 180° extended position) under the weight of an automobile 2. The brake arms 100 are retracted into the release position shown in FIG. 7 by any suitable retracting means, in the embodiment illustrated a conventional pneumatic cylinder 110 which is mounted beneath the piston block 78 and has a piston 112 secured to the shackle 60. The piston 112 is spring-loaded, as by spring 111 (see FIG. 6) to revert to the fully extended position in the absence of pneumatic pressure, which in turn biases the shackle 60 and the brake arms 100 to the extended (braking) position. The pneumatic cylinder 110 is actuated by a compressor (not shown) controlled at the operator's station 80. The retracting means could alternatively be an electrical solenoid, motor or any other means capable of applying a pulling force to the shackle 60, and the invention is not intended to be so limited.

It will be appreciated that both the front and rear sliding assemblies 50 are oriented in the same direction, with the shackle 60 at the rear of each sliding assembly 50, so that the braking mechanisms both operate in the same direction. The front end 74 of the piston 72 approaches the front sliding assembly 50 from the rear, however the rear end 76 of the piston 72 approaches the rear sliding assembly 50 from the front and must therefore extend over the sliding assembly 50 in order to couple to the piston block 78, as shown in FIG. 5. Thus, the sliding body 52 is provided with an arcuate upper edge, as shown in FIG. 8, or is otherwise configured to allow the rear end 76 of the piston 72 to extend over the sliding body 52 and to the shackle 60 of the rear sliding assembly 50.

It can be seen that the rows of slots 29 are generally centred within the channels 28, however the actuating portions 104 of the brake arms 100 are drawn from beneath the sliding body 52. Thus, a spacer block 109 spaces the latching portions 102 of the brake arms 100 from the actuating portions 104, which raises the latching portions to the level of the slots 29. The spacer block 109 is preferably a single piece through which both obround pins 106 pass, and is preferably welded to the sliding body 52 leaving just enough space between the spacer block 109 and the mounting blocks 108 to allow the latching portions 102 to pivot therebetween. This helps to maintain the latching portions 102 of the brake arms 100 in proper alignment with the slots 29.

To install the lift 10 of the invention, one lift assembly 10*a* is secured to the service bay floor 4 in a vertical orientation by bolting or otherwise securing the anchor plates 40 to the floor 4. The other lift assembly 10*b* is located so as to be parallel and aligned front-to-rear with the lift assembly 10*a*, and spaced therefrom according to the wheelbase length of the vehicles 2 to be serviced on the lift 10, and is secured to the service bay floor 4 in like fashion. The hydraulic system is installed, care being taken to ensure that the hoses 82, 84, 86 are secured away from the workspace beneath the lift 10 and will not be crimped or pinched by any of the moving parts of the lift 10. The deck rails 20 are set to the lowered position and any entrained air is bled from the hydraulic system.

In operation, an automotive vehicle 2 is driven up to the rear plates 24 and onto the deck rails 20, to the position shown in FIG. 2. The deck an operator at the remote station 80 by actuating the hydraulic pump 81. As hydraulic fluid is pumped into the cylinder 70*a* through hose 82 it is discharged from the cylinder 70*a* through hose 84 to the cylinder 70*b*. The hydraulic pressure forces the hydraulic pistons 72 rearwardly, which displaces the piston shafts 72 in unison toward the rear of the lift 10. The rearward motion of the piston shafts 72 overcomes the biasing force of the spring-loaded pneumatic cylinders 110, retracting the latching portions 102 of the brake arms 100 from the slots 29, and forces the sliding assemblies 50 to slide rearwardly which in turn causes the deck rails 20 to rise as the angular relation between the legs 30 and the deck rails 20 increases. As the deck rails 20 rise off of the floor 4 the rear plates 24 pivot to a vertical or oblique position and form a barrier against the vehicle 2 rolling off of the rear of the lift 10, as shown in FIG. 3.

It will be noted that the rear edges of the latching portions 102 are rounded, which allows the brake arms 100 to disengage from the slots 29 under the force of the hydraulic cylinders 70. However, the biasing force of the spring-loaded pneumatic cylinders 110 remains present so when the desired elevation has been reached, the operator merely releases the hydraulic pressure and the brake arms 100 are urged back to the extended position. The deck rails 20 fall slightly as the weight of the vehicle 2 forces the sliding assemblies 50 forwardly, causing the brake arms 100 to engage securely into the nearest opposed slots 29. The rounded rear edges of the brake arms 100 also facilitate the brake arms 100 latching into the nearest slot 29 upon release of the hydraulic pressure. However, the latching portions 102 of the brake arms 100 have squared front edges, to ensure that the leading edges of the brake arms 100 securely engage into the slots 29.

Once the brake arms 100 have latched into the slots 29, the sliding assemblies 50 are restrained against further forward movement. Since as between the tow deck rails 20*a*, 20*b* the rows of slots 29 are in precise alignment, any slight deviation in the level of one deck rail 20*a* relative to the other deck rail 20*b* is corrected as the sliding assemblies 50 settle forwardly and the brake arms 100 engage into the slots 29.

The brake arms 100 thus lock the deck rails 20 in the elevated position without the need to maintain the hydraulic pressure, by restraining the sliding assemblies 50 from sliding forwardly. It will thus be apparent that in the event of hydraulic failure during the lifting process, as soon as the hydraulic pressure is released the brake arms 100 will pivot to the extended position under the force of the spring-loaded pneumatic cylinders 110 and engage the slots 29 as shown in FIG. 6, to prevent free-falling of the lift 10. For this reason it is advantageous to provide slots 29 along the entire path of travel of each sliding assembly 50, even if it is unlikely that the lift 10 will be raised to a low elevation, to provide a failsafe against free-falling of the lift 10 at any point during the lifting process.

To lower the deck rails 20 the hydraulic pump 81 is activated, displacing the pistons 72 rearwardly and thereby forcing the shackles 60 to retract the brake arms 52. The deck rails 20 are raised slightly, enough to release the pressure from the brake arms 100. The pneumatic cylinders 110 are then engaged to retract the brake arms 100 from the slots 29. The hydraulic pressure is reduced, to allow for a controlled lowering of the deck rails 20 while maintaining the pneumatic pressure to retain the brake arms 100 in the retracted position shown in FIG. 7. The weight of the vehicle 2 causes the front and rear sliding assemblies 50 to slide forwardly along the deck rails 20 in synchronous relation as the piston shafts 72 are displaced forwardly through the cylinders 70, until the lift 10 has reached the lowered position shown in FIG. 2 at which point the pneumatic pressure can be released.

Optionally a failsafe switch (not shown) activated when the lift 10 is being lowered may be coupled to the operator's station 80, to automatically stop the lowering process, for example at a height of 18 inches. This would give service personnel an additional opportunity to ensure that the area under the lift 10 is clear before the lift 10 is completely lowered to floor level.

Figure 9:
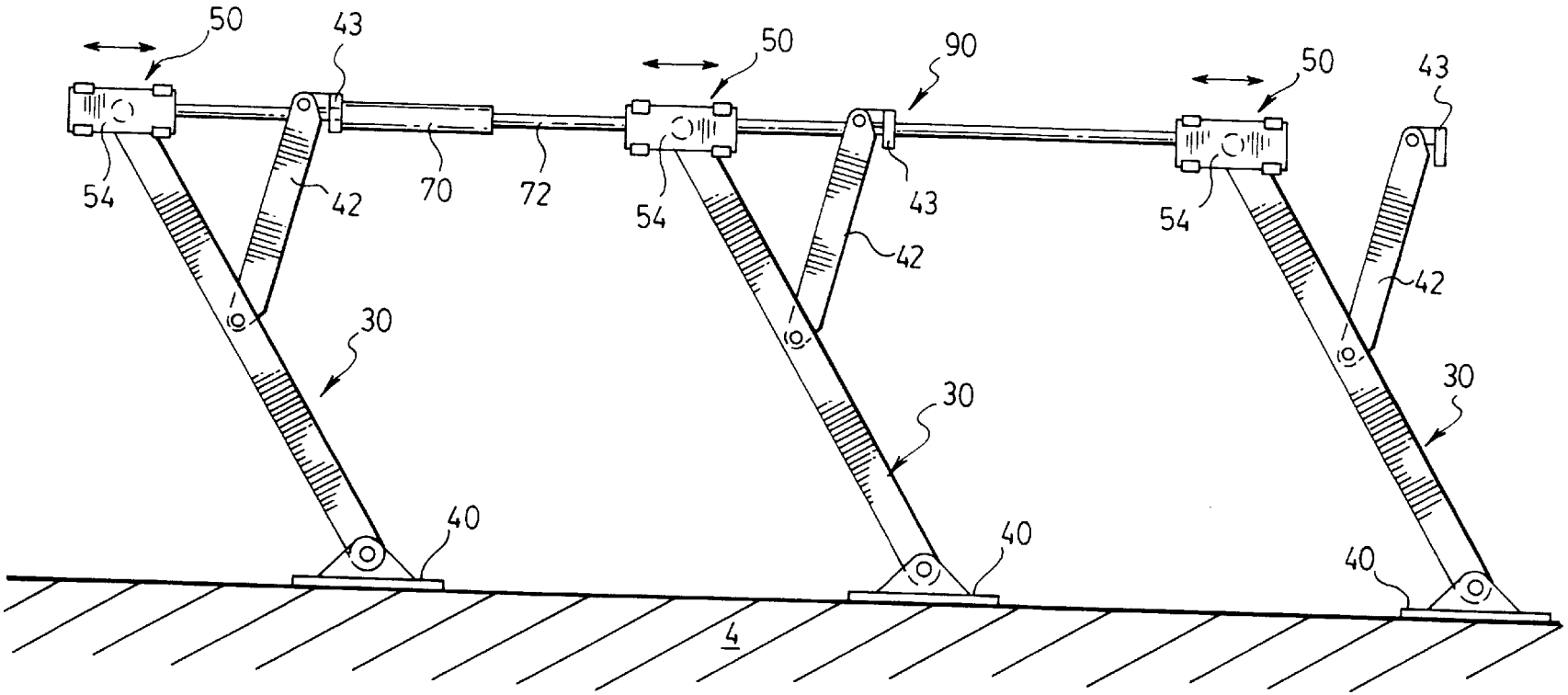
FIG. 9 is a side elevation of the hydraulic system for a further embodiment of the automotive lift of the invention having three legs in each lift section.

The automotive lift 10 thus described is suitable for domestic automotive vehicles. For commercial vehicles a lift 90 having a higher capacity may be required, in which case a third leg can be added to each lift section as shown in FIG. 9, which illustrates the hydraulic system for such a lift. In this embodiment the hydraulic cylinders 70 are positioned between the middle leg 30 and one of the front or rear legs 30 of each lift section 92, and the piston shaft 72 is either coupled to the middle sliding assembly 50 at an intermediate point or, preferably, formed from two sections which screw together at the sliding body 52 associated with the middle leg 30. Otherwise the lift 90 operates in the same fashion as the lift 10 described above.

A preferred embodiment of the invention having been thus described by way of example only, it will be apparent to those skilled in the art that certain modifications and adaptations may be made without departing from the scope of the invention, as set out in the appended claims.

The embodiments of the invention in which an exclusive property or privilege is claimed are defined as follows:

1. An automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, and an associated link arm, having an upper end pivotally secured to the deck rail at a fixed position spaced from the path of travel of the sliding assembly and a lower end pivotally secured to an intermediate portion of the leg, and an actuator for applying a force to each sliding assembly, whereby the actuator forces each sliding assembly to move toward its associated link arm to alter an angulation between the leg relative to the deck rail.

2. The automotive lift of claim 1 in which the lower end of the link arm is pivotally secured to the leg at approximately the midpoint of the leg, so that the deck rail rises substantially vertically.

3. The automotive lift of claim 2 in which a length of the link arm approximately equals a length of the leg from the upper portion of the leg to a point at which the lower portion of the link arm is secured to the leg.

4. The automotive lift of claim 1 in which each deck rail has two legs.

5. The automotive lift of claim 1 in which each deck rail has three legs.

6. The automotive lift of claim 1 in which the sliding assembly comprises a sliding body extending between a pair of wings slidably received in channels formed in the deck rail.

7. The automotive lift of claim 6 in which the sliding body is affixed to the wings by pins disposed through the upper portion of a leg.

8. The automotive lift of claim 1 in which the actuator comprises a hydraulic cylinder.

9. The automotive lift of claim 8 in which the cylinder contains a piston having a front portion which extends forwardly of the cylinder and is affixed to a front sliding body and a rear portion which extends rearwardly of the cylinder and is affixed to a rear sliding body.

10. The automotive lift of claim 8 in which the cylinder actuating one lifting section is connected in series with a cylinder actuating the other lifting section.

11. The automotive lift of claim 1 in which each sliding assembly is provided with a pair of brake arms retractable from an extended position in which the brake arms extend into slots provided in the deck rail to a retracted position in which the brake arms are retracted from the slots, the brake arms being biased toward the slots and being retractable by a force applied to the brake arms.

12. An automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, and an associated link arm, having an upper end pivotally secured to the deck rail at a fixed position spaced from the path of travel of the sliding assembly and a lower end pivotally secured to an intermediate portion of the leg, and a hydraulic cylinder secured at a fixed position on the deck rail to apply a force longitudinally along the deck rail, having a piston with a piston shaft extending from forward and rear ends of the cylinder, a forward end of the piston shaft being coupled to a forward sliding assembly and a rear end of the piston shaft being coupled to a rear sliding assembly, to move the forward and rear sliding assemblies in synchronous relation, the actuator forces each sliding assembly to move toward its associated link arm to alter an angulation between the leg relative to the deck rail and thus raise the deck rail.

13. The automotive lift of claim 12 in which the lower end of the link arm is pivotally secured to the leg at approximately the midpoint of the leg, so that the deck rail rises substantially vertically.

14. The automotive lift of claim 13 in which a length of the link arm approximately equals a length of the leg from the upper portion of the leg to a point at which the lower portion of the link arm is secured to the leg.

15. The automotive lift of claim 12 in which each deck rail has two legs.

16. The automotive lift of claim 12 in which each deck rail has three legs.

17. The automotive lift of claim 12 in which the sliding assembly comprises a sliding body extending between a pair of wings slidably received in channels formed in the deck rail.

18. The automotive lift of claim 17 in which the sliding body is affixed to the wings by pins disposed through the upper portion of a leg.

19. The automotive lift of claim 12 in which the cylinder contains a piston having a front portion which extends forwardly of the cylinder and is affixed to a front sliding body and a rear portion which extends rearwardly of the cylinder and is affixed to a rear sliding body.

20. The automotive lift of claim 12 in which a cylinder actuating one lifting section is connected in series with a cylinder actuating the other lifting section.

21. The automotive lift of claim 12 in which each sliding assembly is provided with a pair of brake arms retractable from an extended position in which the brake arms extend into slots provided in the deck rail to a retracted position in which the brake arms are retracted from the slots, the brake arms being biased toward the slots and being retractable by a force applied to the brake arms.

22. An automotive lift comprising a pair of lifting sections, each lifting section comprising a deck rail for supporting a vehicle, supported by at least two legs, each leg having an associated sliding assembly to which an upper portion of the leg is pivotally affixed, slidably mounted to the deck rail and having a path of travel along a portion of the length of the deck rail, the path of travel having at least one row of slots extending along a portion of the length of the deck rail, and an associated link arm, having an upper end pivotally secured to the deck rail at a fixed position spaced from the path of travel of the sliding assembly and a lower end pivotally secured to an intermediate portion of the leg, and an actuator for applying a force to each sliding assembly, whereby the actuator forces each sliding assembly to move toward its associated link arm to alter an angulation between the leg relative to the deck rail, wherein each sliding assembly is provided with a pair of brake arms retractable from an extended position in which the brake arms extend into the slots to a retracted position in which the brake arms are retracted from the slots, the brake arms being biased toward the slots and being retractable by a force applied to the brake arms.

23. The automotive lift of claim 22 in which the lower end of the link arm is pivotally secured to the leg at approximately the midpoint of the leg, so that the deck rail rises substantially vertically.

24. The automotive lift of claim 23 in which a length of the link arm approximately equals a length of the leg from the upper portion of the leg to a point at which the lower portion of the link arm is secured to the leg.

25. The automotive lift of claim 22 in which each deck rail has two legs.

26. The automotive lift of claim 22 in which each deck rail has three legs.

27. The automotive lift of claim 22 in which the sliding assembly comprises a sliding body extending between a pair of wings slidably received in channels formed in the deck rail.

28. The automotive lift of claim 27 in which the sliding body is affixed to the wings by pins disposed through the upper portion of a leg.

29. The automotive lift of claim 22 in which the actuator comprises a hydraulic cylinder.

30. The automotive lift of claim 29 in which the cylinder contains a piston having a front portion which extends forwardly of the cylinder and is affixed to a front sliding body and a rear portion which extends rearwardly of the cylinder and is affixed to a rear sliding body.

31. The automotive lift of claim 29 in which the cylinder actuating one lifting section is connected in series with a cylinder actuating the other lift section.

32. The automotive lift of claim 22 in which each brake arm comprises a latching portion for engaging the slots and an actuating portion rotatably fixed to the latching portion for retraction by the force applied to the brake arms.

33. The automotive lift of claim 22 in which both brake arms are retracted by a shackle having slots for engaging fastening members affixed to actuating portions of the brake arms.

34. The automotive lift of claim 22 in which the force is applied to the brake arms by a pneumatic cylinder.

* * * * *